US006620464B2

(12) United States Patent
Sciandra

(10) Patent No.: US 6,620,464 B2
(45) Date of Patent: Sep. 16, 2003

(54) COATED CONSTRUCTION SUBSTRATES

(75) Inventor: Vincent Sciandra, Largo, FL (US)

(73) Assignee: Vincor, Clearwater, FL (US)

( * ) Notice: Subject to any disclaimer, the term of this patent is extended or adjusted under 35 U.S.C. 154(b) by 0 days.

(21) Appl. No.: 09/915,101

(22) Filed: Jul. 25, 2001

(65) Prior Publication Data

US 2003/0022011 A1 Jan. 30, 2003

(51) Int. Cl.[7] ..... H01F 1/00

(52) U.S. Cl. ..... 427/547; 427/127; 427/128; 427/129; 427/130; 427/259; 427/261; 427/282; 427/598

(58) Field of Search ..... 427/547, 598, 427/127, 128, 130, 259, 261, 282, 129

(56) References Cited

U.S. PATENT DOCUMENTS

| | | | | |
|---|---|---|---|---|
| 2,918,442 A | | 12/1959 | Gerrard | |
| 3,013,897 A | | 12/1961 | Cupery et al. | |
| 3,170,810 A | * | 2/1965 | Kagan | 427/598 |
| 3,198,690 A | | 8/1965 | Starke | |
| 3,249,463 A | | 5/1966 | Carlee | |
| 3,322,609 A | | 5/1967 | Vida | |
| 3,361,693 A | | 1/1968 | Geschwind | |
| 3,418,201 A | | 12/1968 | Bowman | |
| 3,523,849 A | | 8/1970 | Dunsby | |
| 3,725,504 A | | 4/1973 | Owston | |
| 4,176,100 A | | 11/1979 | Rider | |
| 4,267,221 A | | 5/1981 | Ishikawa | |
| 4,267,222 A | | 5/1981 | Sanders | |
| 4,439,557 A | | 3/1984 | Kawamura et al. | |
| 4,473,610 A | | 9/1984 | Davis | |
| 4,544,595 A | | 10/1985 | Tomason | |
| 4,800,103 A | | 1/1989 | Jeffs | |
| 4,908,257 A | | 3/1990 | Baskin | |
| 5,028,482 A | | 7/1991 | Jeffs | |
| 5,171,622 A | | 12/1992 | Wegner | |
| 5,275,852 A | | 1/1994 | Jones et al. | |
| 5,502,941 A | | 4/1996 | Zember et al. | |
| 5,609,788 A | | 3/1997 | Deetz | |
| 5,843,329 A | | 12/1998 | Deetz | |
| 5,889,088 A | | 3/1999 | Kisuno et al. | |

* cited by examiner

*Primary Examiner*—Bernard Pianalto
(74) *Attorney, Agent, or Firm*—Dennis G. LaPointe; Mason Law, P.A.

(57) ABSTRACT

Construction substrates that have one or more coatings are disclosed. In one embodiment the coating is an adhesive mixture that is magnetically induced to attract a magnetic template. The template that is magnetic or magnetically attracted, that is applied to a construction substrate, is used to create a pattern when a subsequent coating is applied to the substrate. It is emphasized that this abstract is provided to comply with the rules requiring an abstract that will allow a searcher or other reader to quickly ascertain the subject matter of the technical disclosure. It is submitted with the understanding that it will not be used to interpret or limit the scope of meaning of the claims.

12 Claims, 5 Drawing Sheets

COATED CONSTRUCTION SUBSTRATES

This invention relates, generally to construction substrates including building structures and components thereof and pathways leading thereto that have a decorative coating.

Structures, roads, driveways, sidewalks, fences, roofs, floors, panels and the like have been coated in some way to improve their function and/or appearance.

The present invention is directed to a structural substrate having a coating. The structural substrate can be a wall, siding, a panel, a fence, a roof, an interlocking roof panel (tile) a floor, a ceiling, a road, a driveway, a sidewalk, and the like. The structural substrate can be rigid such as cement or flexible such as a metal or plastic sheet or either flexible or rigid such as wood. The invention comprises the features that will be exemplified in the description hereinafter set forth, and the scope of the invention will be set forth in the claims. According to the invention, the coating comprises:

a) an acrylic polymer, b) a chlorinated rubber such as neoprene, and c) sand.

To form a pattern on the structural substrate, two coatings are preferably applied to the structural substrate. The first coating, or bond or adhesive coating, contains:

a) an acrylic polymer, b) a chlorinated rubber, such as neoprene, c) sand, and, d) a first colorant.

The second coating or non-adhesive coating, contains:

a) an acrylic polymer, b) sand, and, c) a colorant, preferably of a different color than the first colorant. The colorant can be the natural color of the composition.

The second coating forms a discontinuous coating on the first coating in the form of a pattern. A third coating can be applied to the top coating on the substrate as a sealing coat, such as a water repellant sealer. Examples are THOMSON water sealer, and DRYVIT sealer.

According to the invention, the structural substrate can have a magnetic coating. The magnetic coating, also an adhesive coating, contains:

a) an acrylic polymer, b) a chlorinated rubber such as neoprene, c) sand, and, d) a finely divided magnetic material on a surface of the structural substrate.

A magnetic template is used in a method of applying a fluid composition to a magnetic structural substrate. The fluid composition contains:

a) an acrylic polymer, b) a chlorinated rubber such as neoprene, and, c) sand.

Illustrative of the invention, the method includes placing a magnetic template on the magnetic structural substrate, then applying the fluid composition. By magnetic is meant magnetic or magnetically attractable. Where the two are used in combination at least one is magnetic. The other can be magnetic or magnetically attractable.

According to the invention, the magnetic template is used in a double coating method of forming a patterned coating on a structural substrate. The first coating is applied by:

a) applying an adhesive fluid composition containing:

a1) an acrylic polymer, a2) a chlorinated rubber such as neoprene, a3) sand, and, a4) a finely divided magnetic material to a structural substrate.

The fluid composition is dried to form a magnetic coating on the structural substrate. Then a magnetically attractable template is placed on the magnetic coating. A second fluid composition is then applied on top of the magnetic coating. The second fluid composition contains:

d1) an acrylic polymer, and d2) sand.

The second layer is dried and the template is removed to form a pattern.

In practicing the present invention, a magnetically attractable template is used to form a pattern on a magnetic surface so long as there is mutual attraction between the two surfaces.

The magnetically attractable or magnetic template is placed on the magnetically attractable or magnetic surface. A coating is then applied to the surface. The template is then removed to form a surface pattern.

The present invention is also useful in creating a structural substrate having a molded surface on both sides. To a panel having two sides is adhesively secured two foamed plastic sheets, one to each of the two sides by an inner surface of each sheet, leaving the outer surface of each foamed sheet exposed. A molded surface is adhesively secured to each of the outer surfaces of each foamed plastic sheet.

BRIEF DESCRIPTION OF THE DRAWINGS

In the accompanying drawings illustrating embodiments of the present invention.

EXAMPLES

The following examples are presented to illustrate the invention, which is not intended to be in any way limited thereto, since numerous modifications and variations therein will be apparent to one skilled in the art.

Example 1

Figure 1:
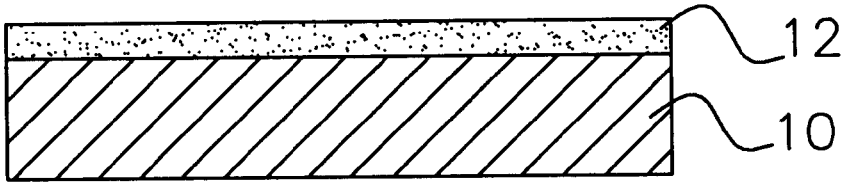
FIG. 1 is a cross sectional view of a plastic substrate coated with a sand filled acrylic, chlorinated rubber composition.

One gallon of WELDBOND adhesive was mixed thoroughly with one quart of DRYVIT ULTRATEX acrylic sand coating. DRYVIT ULTRATEX acrylic sand coating is comprised of sand in an acrylic emulsion. DRYVIT ULTRATEX acrylic sand coating is believed to have a composition similar to that of DRYVIT acrylic sand coating. DRYVIT acrylic sand coating contains from sixty two to sixty six percent by weight of encapsulated sand, three to seven percent by weight of silicates, twelve to fifteen percent by weight of water, eight and one half percent to ten and two tenths percent by weight of acrylic latex polymer/binder and one to five and one half percent by weight of titanium dioxide. WELDBOND adhesive is comprised of a chlorinated rubber such as neoprene-based contact cement, which contains methyl ethyl ketone (MEK) and toluene. An adhesive roller is used to apply the mixture as a coating 12 to a metal or a plastic panel 10 (See FIG. 1). The coating 12 is allowed to dry and/or cure for up to twenty-four hours. The DRYVIT ULTRATEX is a grout coat. The benefit of the formula is the elasticity and bonding it provides. It is also resistant to mildew and algae growth. The composition is useful for coating flexible panels such as steel, aluminum, and plastic panels such as POLYCOR plastic panels or PLASTICOR plastic panels. POLYCOR plastic panels are believed to be made from polyester resin. PLASTICOR plastic panels contain polypropylene copolymer and polyethylene, and have a thickness of from two to ten millimeters. PLASTICOR is corona treated on both sides to improve adhesion.

Example 2

Example 1 was repeated using STOSILCO FLEX #S.W.1 acrylic sand coating instead of DRYVIT ULTRATEX. STOSILCO FLEX #S.W.1 is comprised of sand in an acrylic or emulsion and is silicone enhanced. The composition of Example 2 was found to be very useful in bridging hairline cracks in stucco, cement and other substrates.

Example 3

Figure 2:
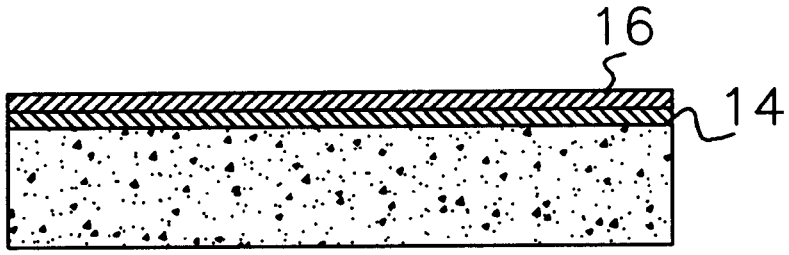
FIG. 2 is a cross sectional view of a cement substrate having two coatings of contrasting colors.
Figure 3:
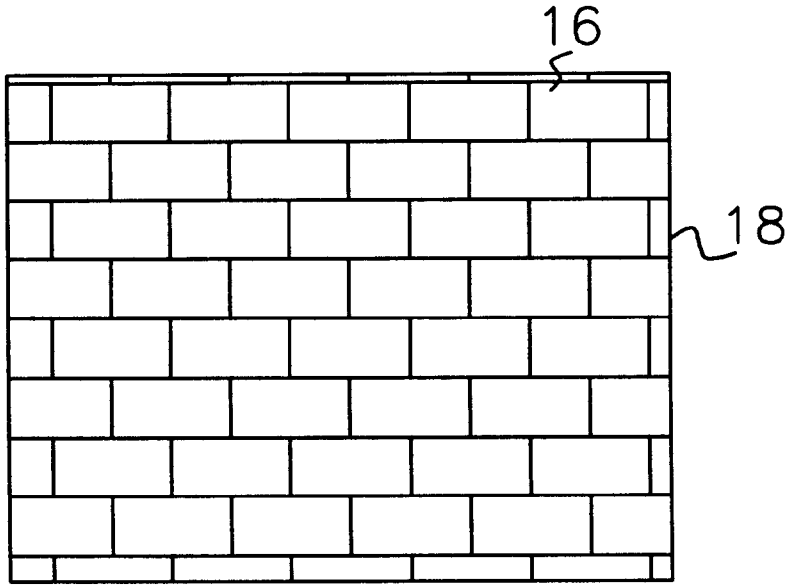
FIG. 3 is a front view of the coated substrate of FIG. 2 showing the brick pattern formed.

Example 1 was repeated using DRYVIT acrylic sand coating 14 (see FIGS. 2 and 3) instead of DRYVIT ULTRATEX. DRYVIT has a red or black brick color. A patterned coating of DRYVIT ULTRATEX 16 on a grout colored substrate forms a panel looking like a brick wall 18. The composition of DRYVIT is disclosed above.

Example 4

Figure 4:
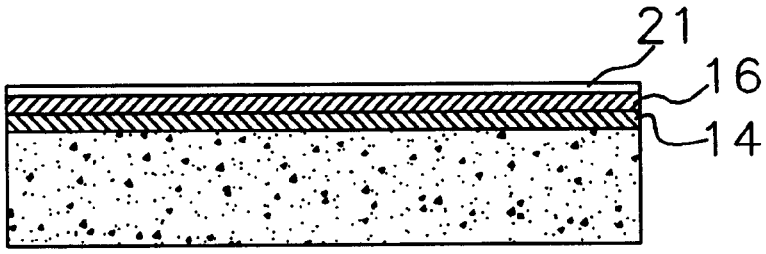
FIG. 4 is a cross sectional view of the substrate of FIG. 2 having an additional clear sealing coat.

Example 3 was repeated and a finish, sealer coat 21 (see FIG. 4) was applied to the decorative panel 18. The sealer can be any commercial masonry sealer such as Thompson Water Sealer or a sealer from Dryvit Systems, Inc.

Example 5

Figure 5:
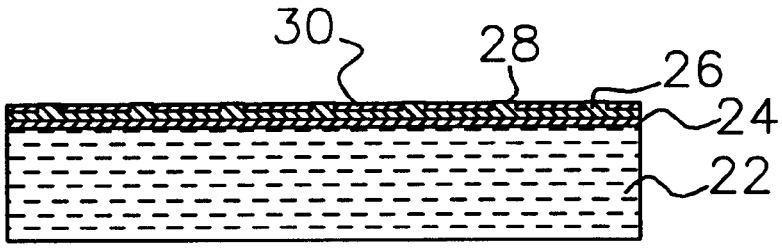
FIG. 5 is a cross sectional view of a coated substrate having a stencil between coating layers.
Figure 6:
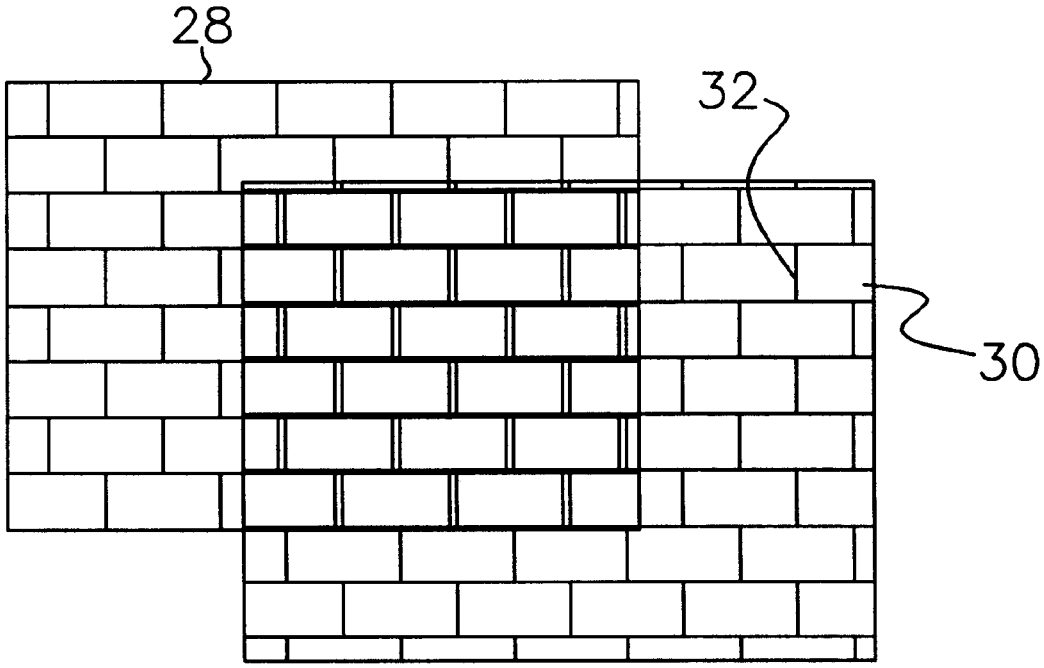
FIG. 6 is a front view of the coated substrate of FIG. 5 with the stencil removed showing grout lines.

One gallon of WELDWOOD brand contact cement was mixed with one half quart of DRYVIT ULTRATEX acrylic based sand coating material containing iron filings and having a dark gray color. The contact cement is a chlorinated rubber such as neoprene rubber dissolved and/or dispersed in naphtha and/or other organic solvent such as toluene. The mixture was rolled onto a POLYCOR plastic panel 22 (see FIG. 5) and allowed to dry and/or cure for twenty four hours to form coating 24. DRYVIT ULTRATEX acrylic based sand adhesive coating material was then trowled onto the coated panel to form coating 26. After drying and curing, a magnetic steel grout stencil 28 was placed over the coated panel and another coating of DRYVIT ULTRATEX acrylic based sand finish was applied to form coating 30. After four hours, the magnetic steel stencil 28 was pulled from the coated panel to create grout lines 32.

Example 6

Figure 7:
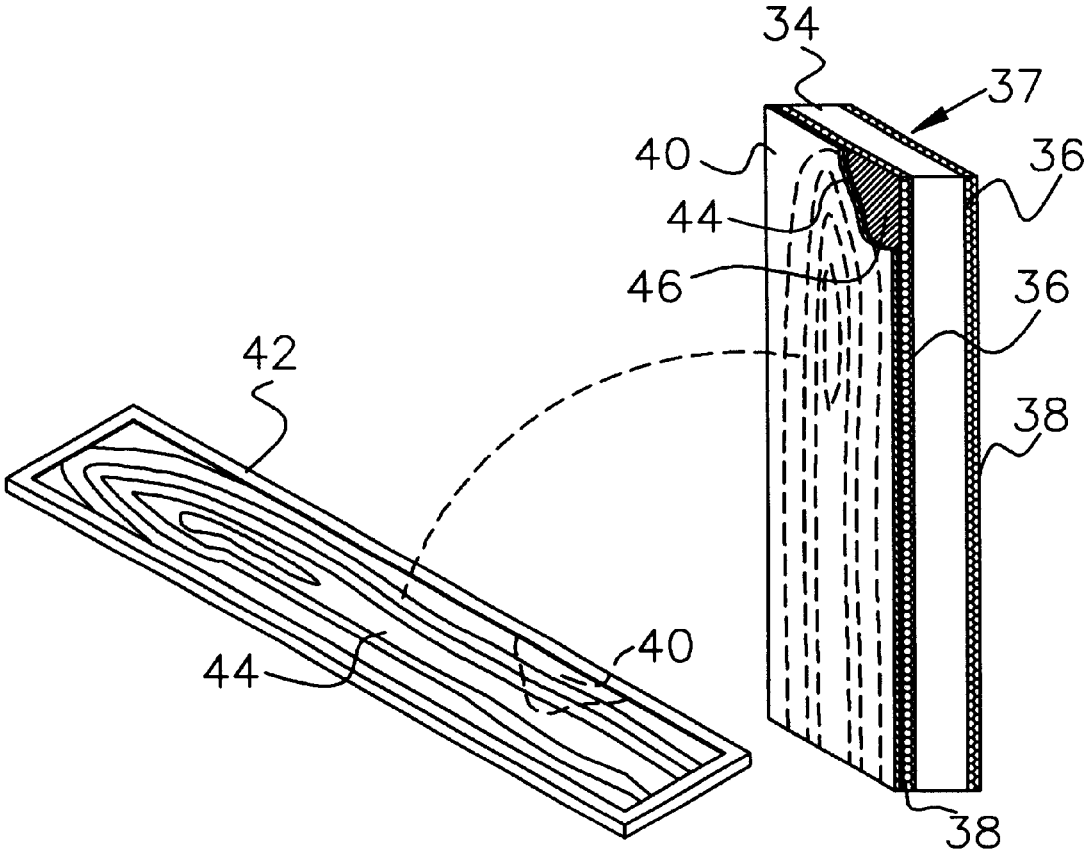
FIG. 7 is a cross sectional view of a procedure for attaching molded surfaces to both sides of a foam plastic sandwich.

A plastic panel 34 (see FIG. 7) six feet long, six inches wide and one half inch thick was coated on both sides with two ounces of water activatable MORTON adhesive 36. The MORTON adhesive 36 was first applied to one side of the plastic panel 34 and subjected to a water mist to activate the adhesive 36 and then the same procedure was applied to the other side to form a sandwich 37 with one fourth inch thick plastic foam 38. Pressure was applied to the sandwich 37 and the sandwich was dried for twenty-four hours.

A decorative coating is prepared by Spraying Gordon #808 water based carnauba wax 40 onto a rubber mold 42, then waiting for a few minutes, then spreading sixteen ounces of DRYVIT ULTRATEX polymer finish 44 with a trowel into the mold and allowing the ULTRATEX polymer 44 to dry about twenty four hours.

MORTON 640 adhesive 46 was trowled onto the DRYVIT ULTRATEX 44 polymer in the mold and onto one side of the plastic sandwich 37. The mold was placed on one side of the sandwich with the ULTRATEX coated surfaces 46 in contact and pressure was applied overnight.

An edge of the polymer in the mold was gently grabbed and the mold 42 was pulled to separate the mold 42 from the molded surface on the sandwich 37. The procedure was repeated to form a molded surface on the other side of the sandwich. The procedure was used to make imitation wood.

The plastic panel 34 can be flexible or rigid.

Example 7

Figure 8:
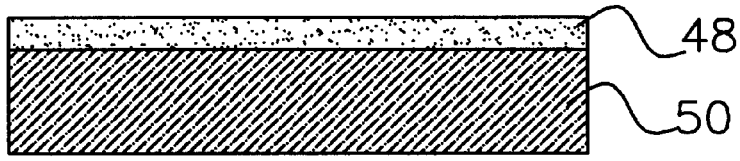
FIG. 8 is a cross sectional view of a substrate coated with a magnetic coating.

Mixing one gallon of WELDBOND adhesive with one quart of DRYVIT ULTRATEX acrylic sand material is an example of a material 48 (see FIG. 8) that can be used to form a substrate for a magnetic stencil. The WELDBOND adhesive is a contact cement. Twelve ounces of the above mixture are then mixed with eighteen ounces of magnetic paint. The final product is then troweled onto a structure, such as a driveway, sidewalk, roof, panel or a wall 50 to form a magnetic coating on the structure.

Example 8

Three ounces of the WELDBOND adhesive and the DRYVIT ULTRATEX mixture of Example 7 are mixed with six ounces of iron shavings to form a magnetic final product.

Example 9

Figure 9:
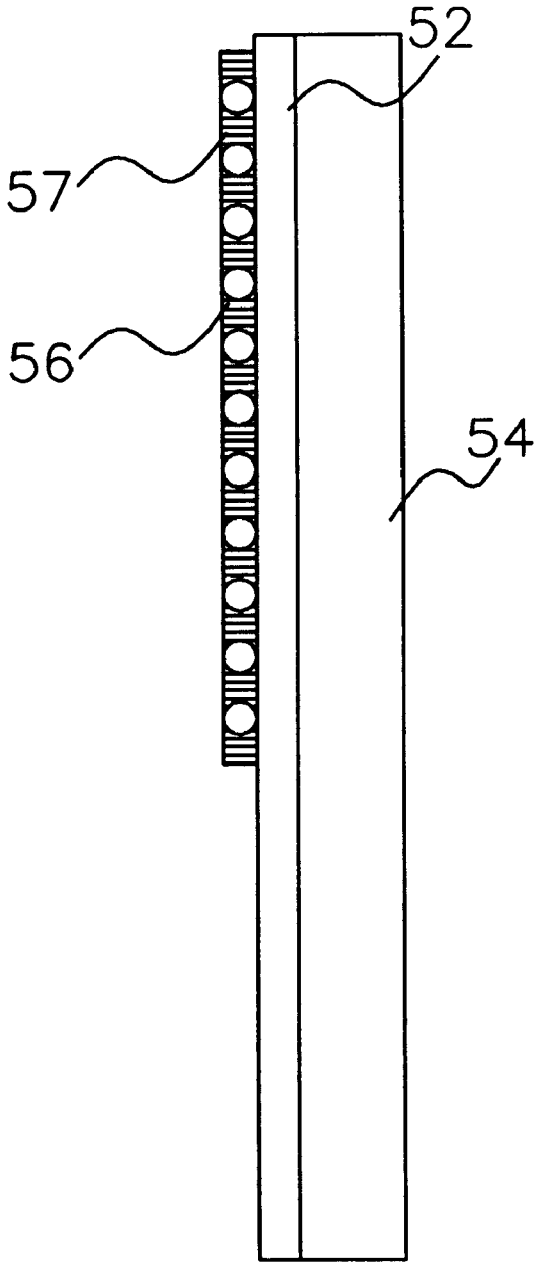
FIG. 9 is a cross sectional view of a large coated wall, a smaller stencil and a coating over the stencil.
Figure 10:
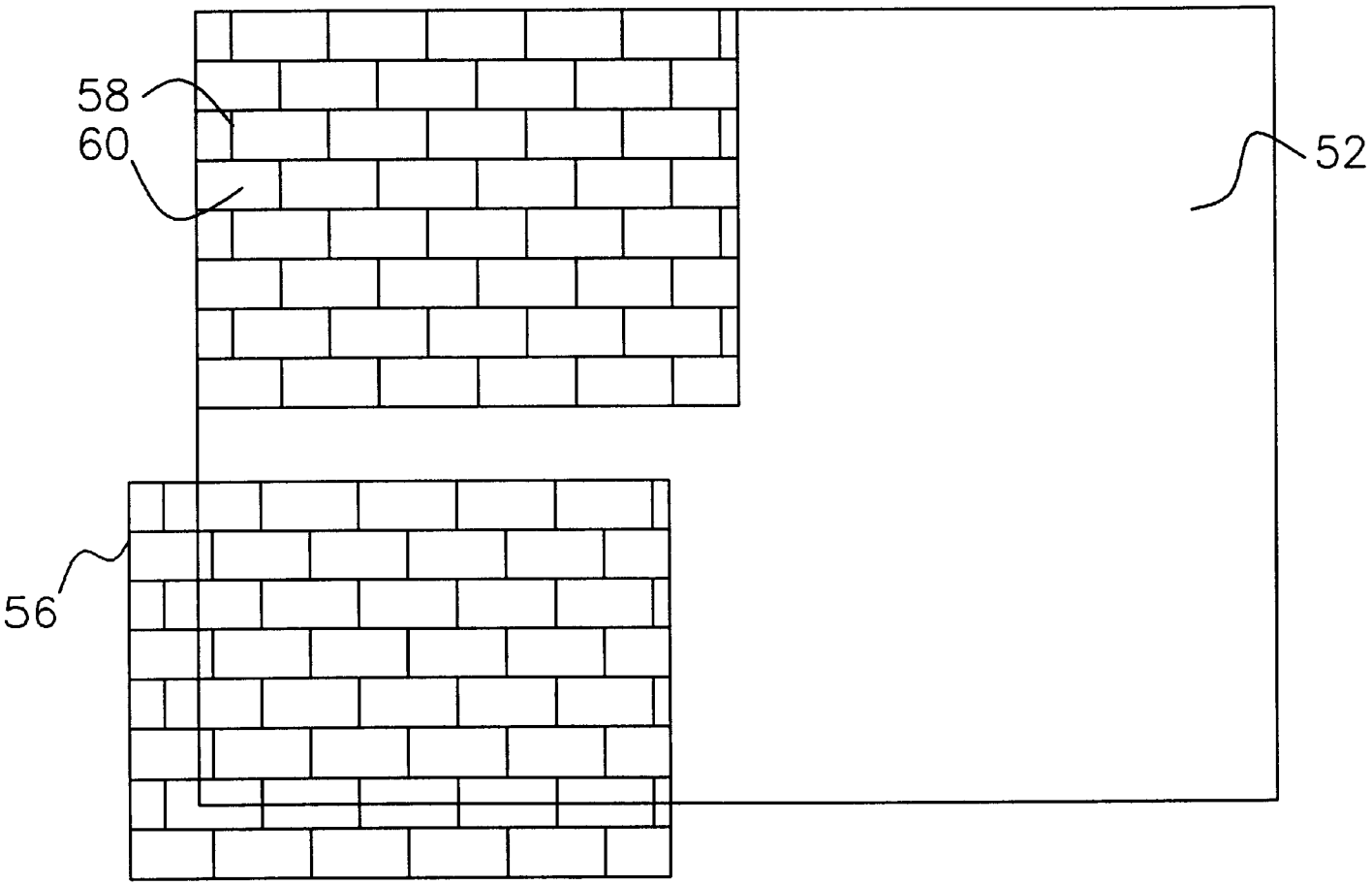
FIG. 10 is a front view of the wall with the stencil removed, showing grout lines.

A magnetic paint formulation is prepared by mixing one gallon of WELDWOOD DAP adhesive with one quart of DRYVIT ULTRATEX acrylic sand material. To the mixture is added two times the weight of the mixture of magnetic or magnetizable shavings, filings or powder. The material 52 (see FIG. 9) is trowled on the entire surface of a wall 54 and allowed to cure and dry for twenty-four hours. A magnetic stencil 56 made of magnetized steel is applied to a three foot by four foot section of the wall 54 and DRYVIT sand filled acrylic latex alone 57, which has a brick color, is applied. After the DRYVIT sand filled acrylic latex dries, the stencil 56 is removed leaving a grout pattern 58 (see FIG. 10) between the imitation bricks 60. WELDWOOD DAP adhesive is believed to be a contact cement containing a halogenated rubber in naphtha and/or other organic solvent such as toluene. The contact cement can also be in the form of an emulsion in water.

Any finely divided magnetic material or magnetizable material such as shavings, filings, or powder can be used in any formulation of the present invention. The magnetizable material can be made magnetic using a solenoid. A solenoid can also be used to magnetize a magnetizable panel. By magnetic stencil is meant any stencil that is attracted by a magnetic field and/or any stencil that is magnetized.

Other components can be present in the compositions of the present invention such as titanium dioxide, perlite, marble, silica, and calcium carbonate, to name but a few. The components, including sand can be encapsulated in an organic polymer to aid in forming a dispersion in the coating compositions of the present invention.

It should be understood that the preceding is merely a detailed description of the embodiments to the present invention and that numerous changes to the disclosed embodiments can be made in accordance with the disclosure herein without departing from the spirit and scope of the invention. The preceding description therefore, is not meant to limit the scope of the invention. Rather, the scope of the invention is to be determined only by the appended claims and their equivalents.

What is claimed is:

1. A method of applying a fluid composition comprising: one of an acrylic polymer, a chlorinated rubber such as neoprene, and sand, an acrylic polymer, a chlorinated rubber such as neoprene, sand and a finely divided magnetically attractable material, and an acrylic polymer and sand, to a structural substrate having a magnetic field applied to it, comprising:

d) placing a magnetically attractable template on the magnetized structural substrate, so that the template is magnetically held in place to the magnetized structural substrate, and then, e) applying the fluid composition.

2. The method according to claim 1, further comprising an admixture of a colorant to the fluid composition.

3. The method according to claim 1, wherein the chlorinated rubber is neoprene.

4. A method of forming a patterned coating on a structural substrate comprising:

a) applying a fluid composition containing:

one of an acrylic polymer, a chlorinated rubber such as neoprene, sand, and a finely divided magnetically attractable material, an acrylic polymer, a chlorinated rubber such as neoprene, and sand, an acrylic polymer and sand, to a structural substrate having a magnetic field applied to it;

b) drying the fluid composition to form a first coating layer on the structural substrate, c) placing a magnetically attractable template on the first coating layer, so that the template is magnetically held in place to the magnetized structural substrate, d) applying a second fluid composition on the first coating layer to form a second coating layer, the second fluid composition containing: one of the above fluid compositions, e) drying the second coating layer, and f) removing the template to form a pattern.

5. The method according to claim 4, further comprising an admixture of a colorant to the fluid composition.

6. The method according to claim 4, wherein the chlorinated rubber is neoprene.

7. A method of forming a pattern on a magnetic surface comprising:

a) placing a magnetically attractable template on the surface, b) applying a coating to the surface, and c) removing the template to form a surface pattern:

wherein the coating is made from a fluid composition containing one of:

an acrylic polymer, a chlorinated rubber such as neoprene, sand, and a finely divided magnetically attractable material, an acrylic polymer, a chlorinated rubber such as neoprene, and sand, an acrylic polymer and sand.

8. The method according to claim 7, further comprising an admixture of a colorant to the fluid composition.

9. The method according to claim 7, wherein the chlorinated rubber is neoprene.

10. A method of forming a pattern on a surface comprising:

a) placing a magnetically attractable template on the surface, b) applying a coating to the surface, and c) removing the template to form a surface pattern, wherein the coating is made from a fluid composition containing one of:

an acrylic polymer, a chlorinated rubber such as neoprene, sand, and a finely divided magnetically attractable material, an acrylic polymer, a chlorinated rubber such as neoprene, and sand, an acrylic polymer and sand.

11. The method according to claim 10, further comprising an admixture of a colorant to the fluid composition.

12. The method according to claim 10, wherein the chlorinated rubber is neoprene.

* * * * *

UNITED STATES PATENT AND TRADEMARK OFFICE

CERTIFICATE OF CORRECTION

PATENT NO. : 6,620,464 B2
DATED : September 16, 2003
INVENTOR(S) : Vincent Sciandra It is certified that error appears in the above-identified patent and that said Letters Patent is hereby corrected as shown below:

Column 5,
Lines 26, 28, 47 and 48, remove the words “such as neoprene”
Lines 50 and 51, remove the words “such as neoprene”

Column 6,
Lines 26 and 27, remove the words “such as neoprene”
Lines 29 and 30, remove the words “such as neoprene”
Lines 43 and 44, remove the words “such as neoprene”
Lines 46 and 47, remove the words “such as neoprene”

Signed and Sealed this

Twentieth Day of January, 2004

JON W. DUDAS
*Acting Director of the United States Patent and Trademark Office*